US007793605B2

(12) United States Patent
Poldervaart et al.

(10) Patent No.: US 7,793,605 B2
(45) Date of Patent: Sep. 14, 2010

(54) SIDE-BY-SIDE HYDROCARBON TRANSFER SYSTEM

(75) Inventors: Leendert Poldervaart, Monaco (MC); Jack Pollack, Houston, TX (US); Hein Wille, Eze Village (FR); Hein Oomen, Nice (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 11/587,672

(22) PCT Filed: Apr. 29, 2005

(86) PCT No.: PCT/NL2005/000328

§ 371 (c)(1),
(2), (4) Date: Aug. 21, 2007

(87) PCT Pub. No.: WO2005/105565

PCT Pub. Date: Nov. 10, 2005

(65) Prior Publication Data

US 2007/0289517 A1 Dec. 20, 2007

(30) Foreign Application Priority Data

Apr. 29, 2004 (EP) ..... 04076313

(51) Int. Cl.
*B63B 3/24* (2006.01)

(52) U.S. Cl. ..... 114/230.15; 141/387

(58) Field of Classification Search ..... 141/387; 137/615; 114/230.15–230.19, 230.22–230.24, 114/230.1; 414/137.9–138.2
See application file for complete search history.

(56) References Cited

U.S. PATENT DOCUMENTS

| | | | | |
|---|---|---|---|---|
| 2,440,972 | A * | 5/1948 | Peltier | 114/230.19 |
| 2,771,053 | A * | 11/1956 | Gustafson | 114/230.19 |
| 3,051,448 | A * | 8/1962 | Pletta | 114/230.24 |
| 3,422,783 | A * | 1/1969 | Moulin | 114/144 B |
| 3,434,491 | A | 3/1969 | Bily | |
| 3,675,680 | A * | 7/1972 | Frohlich et al. | 137/615 |
| 4,109,688 | A * | 8/1978 | Jameson | 141/387 |
| 5,501,625 | A | 3/1996 | Belinsky | |
| 6,854,408 | B2 * | 2/2005 | De Baan | 114/230.19 |
| 2005/0039802 | A1 * | 2/2005 | Baan | 137/615 |

FOREIGN PATENT DOCUMENTS

| | | |
|---|---|---|
| EP | 1 283 159 | 12/2003 |
| EP | 1 413 511 | 4/2004 |

* cited by examiner

*Primary Examiner*—Edwin Swinehart
(74) *Attorney, Agent, or Firm*—The Webb Law Firm

(57) ABSTRACT

The invention relates to a mooring system with a first vessel for containing hydrocarbons having at its bow and/or stern a transverse arm and a fluid transfer mechanism of a duct connected to a tank on the first vessel and a coupling end for connecting to a second vessel. The second vessel is moored alongside the first vessel and is attached via at least one cable, extending from its bow in the length direction of the vessel, to a mooring end of the arm. The mooring end of the arm is situated at or near a longitudinal centerline of the second vessel. The arm, during use, is in a fixed position and a pulling force element is attached to the cable for applying a pulling force on the cable upon relative movement of the second vessel with respect to the arm. The force element allows a predetermined maximum displacement of the second vessel.

11 Claims, 11 Drawing Sheets

SIDE-BY-SIDE HYDROCARBON TRANSFER SYSTEM

BACKGROUND OF THE INVENTION

1) Field of the Invention

The invention relates to a mooring system comprising a first vessel for containing hydrocarbons having at its bow and/or stern a transverse arm and a fluid transfer means comprising a duct connected to a tank on the first vessel and a coupling end for connecting to a second vessel, the second vessel being moored alongside the first vessel and being attached via a cable, extending from its bow in the length direction of the vessel, to a mooring end of the arm, which mooring end of the arm is substantially situated at or near a longitudinal centreline of the second vessel.

2) Description of the Related Art

Such a mooring system is known from EP 1 413 511, which shows a side-by-side mooring configuration of a permanently moored vessel and a tanker vessel, which is attached to the permanently moored vessel via a transverse arm extending from the latter. The tanker is moored to the arm via an inelastic mooring line, whereas the arm is resiliently hingeable around a vertical axis. A piston provides a restoring force on the arm, and allows pivoting or the arm, during use, when the vessel exerts a pulling force on the hawser. When the vessel rides up against the arm, it can freely rotate out of the way of the vessel.

The known mooring system has as a disadvantage that the position of the tanker will change in a sideways direction upon an excursion in the length direction of the tanker relative to the permanently moored vessel. The offloading arm for the hydrocarbons needs to make a relatively large excursion.

The present invention has as an object to provide a side-by-side mooring system of the above-mentioned type which can connect two vessels in relatively high sea states and allows the vessels to remain moored in a defined relative position while transferring hydrocarbons from one vessel to the other in high sea states.

It is another object of the present invention to provide a mooring system which maintains a stable configuration and a relatively large safety distance during hydrocarbon transfer in high sea states.

It is again an object of the present invention to provide a mooring system using a substantially mid-ship position of the hydrocarbon transfer duct-or ducts without being subject to large excursions.

SUMMARY OF THE INVENTION

Hereto the mooring system according to the present invention is characterized in that:

- the arm, during use, is in a fixed position, a pulling force element being attached to the cable for applying a pulling force on the cable upon relative movement of the second vessel with respect to the arm, the force element allowing a predetermined maximum displacement of the second vessel,
- the fluid transfer means comprising a frame extending upwardly from a side of the first vessel, hingingly attached around a first hinge axis that extends in the length direction of the vessel, a transverse arm being hingingly connected to an upper end of the frame around a second axis that extends in the length direction of the vessel, a counterweight being placed on one end of the transverse arm and a vertical fluid duct being supported from the transverse arm, the vertical duct having at its coupling end a connecting member for attaching to the second vessel, the vertical duct being displaceable in the length direction of the vessels by a distance corresponding to the predetermined maximum displacement.

By using a transverse mooring arm which cannot rotate during use, the second vessel will not be displaced in a sideways direction when it moves in the length direction. The restoring force on the second vessel is exerted by the force element acting in the length direction of the vessels only, such that no sideways movement is caused. Hereby stable mooring in high sea states (for instance wave heights of 3-3.5 m) is possible while maintaining a minimum safety distance between the two vessels.

The transverse mooring arm may for instance have a length of 10 m or more, such that the distance between the two vessels can be of the same order of magnitude. Maintaining a relatively large distance between the vessels separates the stored volumes of hydrocarbons, which is favourable in case of an accident on one of the vessels, and avoids vessel interaction and wave build up between the vessels. The arm may be pivotable towards a parking position when no vessel is moored to the arm.

Because the mooring configuration according to the present invention is very stable and relative movements of the two vessels are relatively small, the hydrocarbon transfer arm or arms will be subject to relatively small excursions. The vertical duct of the hydrocarbon transfer arm can be a flexible duct, a rigid pipe or combinations thereof. Since the relative displacements of the vessels are limited, the vertical duct needs to be movable in a manner such as to accommodate these relatively small displacements. This results in a favourable force distribution and dynamics of the transfer ducts with resultant reduced wear and maintenance. In the length direction, the varying mooring positions due to drift of the moored second vessel or varying dimensions of the second vessel and varying positions of the loading-offloading manifold can be taken up by the displacement of the vertical duct.

Preferably a pulling force element is connected between the frame supporting the vertical fluid transfer duct and the vessel for controlling the inclination of the frame, and a pivoting force element being connected to the frame and its transverse arm, for controlling of pivoting of the transverse arm relative to the frame.

The fluid transfer means according to the present invention can favourable accommodate the following static misalignments between the two vessels:

- misalignments due to the carrier being moored with a longitudinal offset between the fluid transfer means and the loading manifold on the carrier,
- sway offset due to the transverse position of the loading manifold on the carrier with respect to the side of the carrier,
- changes in vertical height of the carrier manifold relative to the fluid transfer means on the second vessel.

Also, static changes can be taken up in an effective manner by the fluid transfer means according to the present invention such as changes in draft of the vessels during loading-unloading.

Upon displacement of the vertical duct in the length directions of the vessel, the inclination force element will pivot the frame of the fluid transfer means to compensate for the resulting vertical displacement of the vertical duct. The pivoting of the frame will also cause a transverse correction to correct the sway misalignment caused by the displacement in the length direction.

In an embodiment the transverse mooring arm is pivotably connected to a mooring point that is anchored to the sea bed.

In this manner, the weathervaning point around which vessels turn in response to the direction of wind and current-induced forces, is placed between the two vessels in a moored configuration and can be placed in line with the first vessel when no carrier is moored alongside.

BRIEF DESCRIPTION OF THE DRAWINGS

Some embodiments of a mooring system according to the invention will be explained in detail with reference to the accompanying drawings. In the drawings.

DETAILED DESCRIPTION OF THE INVENTION

Figure 1:
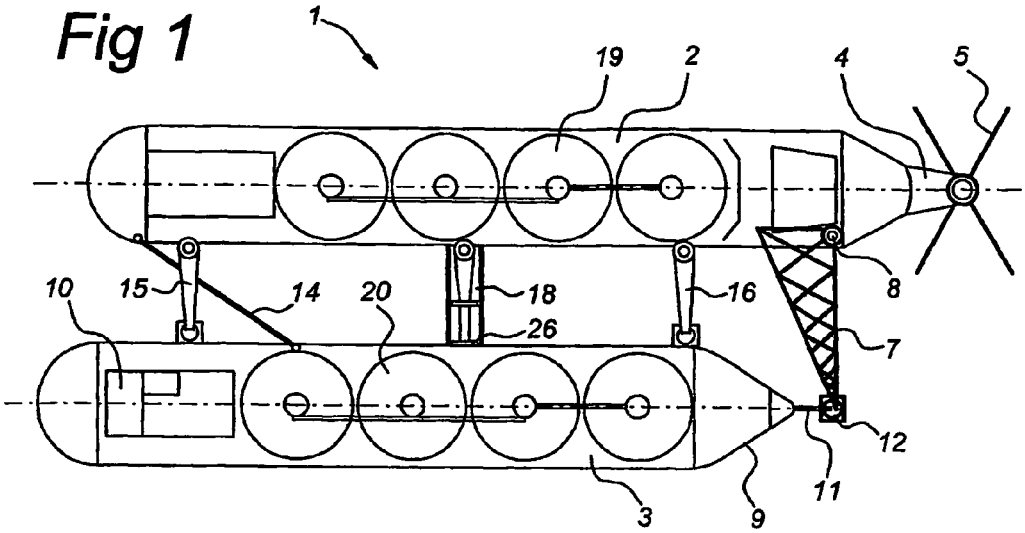
FIG. 1 shows a top view of a mooring system of the present invention comprising a Floating Storage and Regasification Unit (FSRU) and a moored LNG carrier.

FIG. 1 shows the mooring system 1 comprising a floating storage and regasification unit (FSRU) 2 and moored alongside, a LNG carrier 3. The FSRU 2 is moored to the seabed via an external turret 4 that is anchored to the sea bed via anchor lines 5. A transverse mooring arm 7 is attached to the side of the FSRU. The mooring arm 7 can rotate around hinge point 8 to a parking position in which it is parallel to a length direction of the FSRU. In the operative position of the mooring arm 7, it is locked in position such that rotation around the hinge point 8 is not possible.

Figure 2:
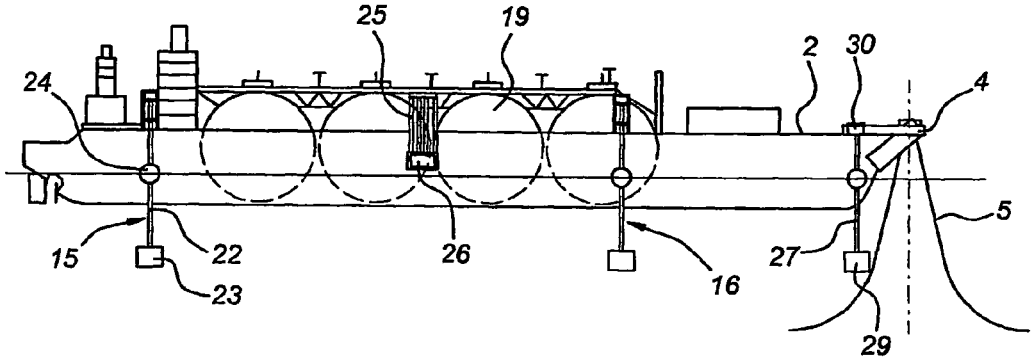
FIG. 2 shows a side view of the FSRU of FIG. 1, FIGS. 3 and 4 show a schematic top view of a mooring system comprising a transverse arm having a weathervaning mooring point.

The carrier 3 is attached to mooring arm 7 at the bow 9 of the carrier, at the height of the centre line 10. A hawser 11 is attached to a pulling force element 12 for exerting a tensioning force on the hawser 11. The pulling force element 12 may be a constant tension winch, a hydraulic cylinder, a counterweight or other force elements suitable for exerting a force on the hawser 11. For reasons of safety and redundancy the mooring arm 7 can be provided with multiple pulling force elements and hawsers. At the stern the carrier 3 is moored to the FSRU 2 via at least one anchor line 14. Fenders 15, 16 maintain a predetermined distance between the vessels 2, 3 such as a distance of 10 m or more. As shown in FIG. 2, the fenders 15, 16 may comprise a cable 22 suspended from a support on the FSRU, carrying a clump weight 23 below water level. A resilient member 24 is attached to the cable for contacting the carrier 3, such that a sideways restoring force is exerted on the carrier 3 when it approaches the FSRU 2.

A fluid transfer means 18 is provided connecting the LNG tanks 19 on the FSRU to the tanks 20 on the carrier 3. The transfer means 18 comprise one or more vertical fluid transfer ducts 25 with at their end a coupling member 26 for attaching the fluid loading/offloading manifold on the carrier 3. The vertical transfer ducts 25 can be displaced in the length direction of the FSRU 2 by a distance which corresponds with the relative excursion of the carrier in the length direction that is allowed by the hawsers 11, 14.

As can be seen from FIG. 2, the pulling force member 12 comprises a cable 27 and submerged counterweight 29, attached to the hawser 11 via a sheave 30 on the end of the arm 7.

Figure 3:
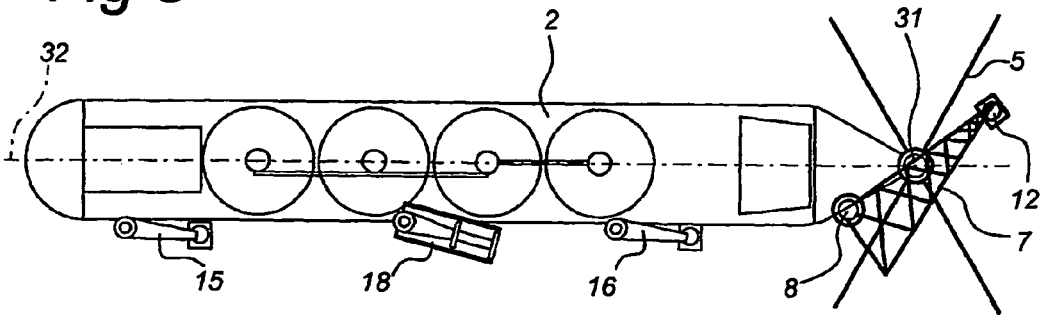

In FIG. 3 it is shown that the mooring arm 7 is provided with a turret 31 which is anchored to the sea bed via anchor lines 5. When no carrier is moored alongside the FSRU 2, the fluid transfer means 18 and the fenders 15, 16 are hinged substantially parallel to the length direction of the FSRU into a parking position. The arm 7 is locked in position such that the turret 31 is situated at the bow of the carrier 2, on the centreline 32.

Figure 4:
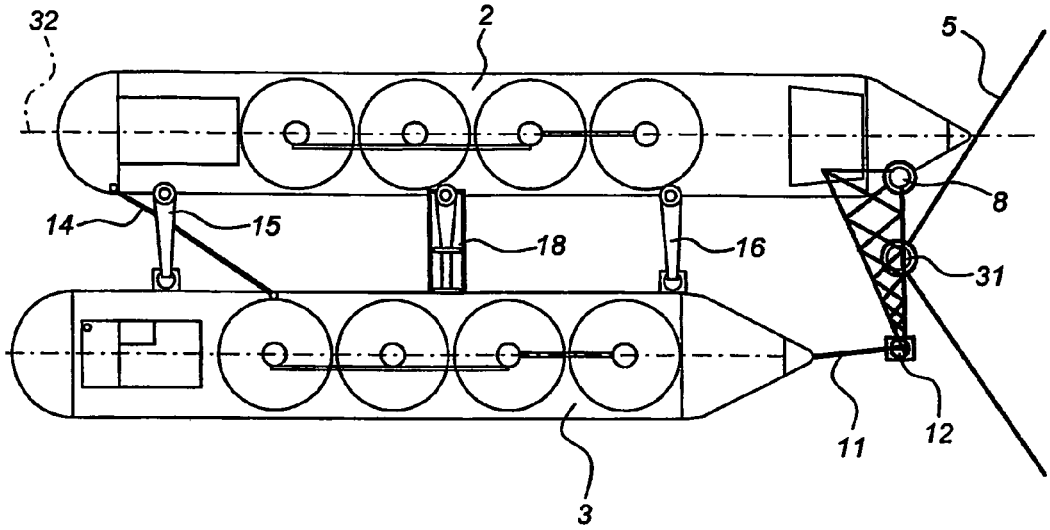

As shown in FIG. 4, when a carrier is moored alongside the FSRU, the arm 7 is rotated around the hinge point 8 to extend transversely to the FSRU, and is locked in position. The turret 31, and hence the weathervaning point is situated in between the vessels 2, 3.

Figure 5:
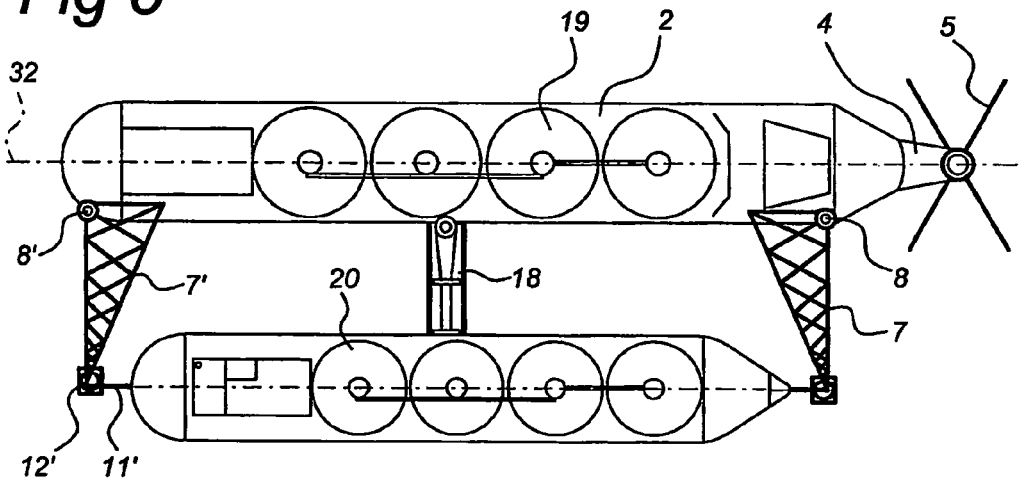
FIG. 5 shows an embodiment comprising two transverse mooring arms, FIGS. 6*a*-6*e* schematically illustrate the berthing process of two vessels according to the present invention.

In the embodiment of FIG. 5 an additional mooring arm 7' rotatable in hinge point 8' is situated at the stern of the FSRU 2. The carrier 3 is at the stem attached to a pulling force member 12' at the end of the arm 7' via hawser 11'. No fenders need be employed in this embodiment for maintaining a predetermined distance between the carrier 3 and the FSRU 2.

Figure 6A:
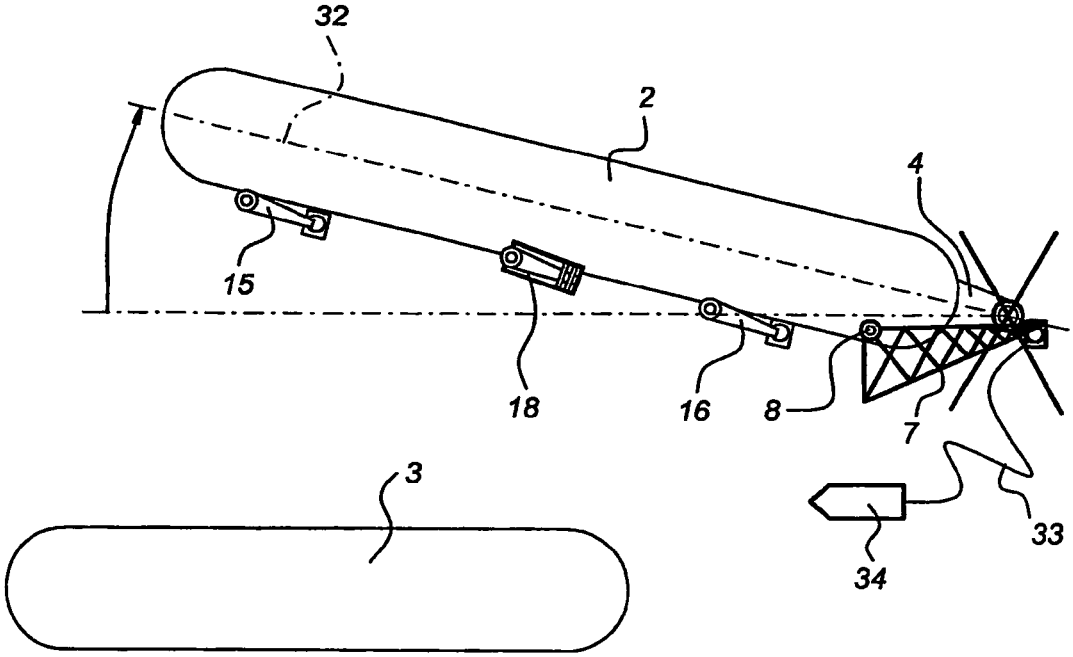

In FIG. 6*a* the first stage of the berthing sequence for the LNG carrier 3 alongside the FSRU 2 is shown. The arm 7 is attached to the turret 4, and the FSRU is aligned against the wind direction. A cable 33 is attached to the end of the arm 7, and is pulled by a tug 34 such that the arm 7 is rotated transversely to the length direction of the FSRU 2 to be locked in that position. A Tug 35 pushes in a sideways direction against the stern of the FSRU, such that is rotated around the turret 4 and is aligned parallel with the carrier 3.

Figure 6B:
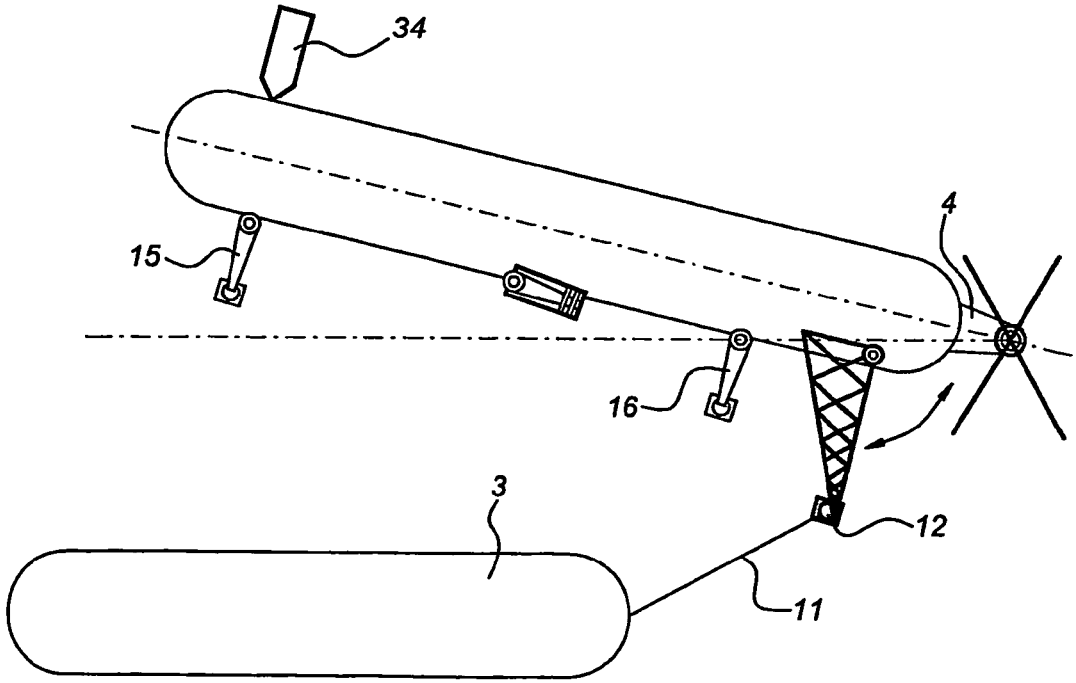
Figure 6C:
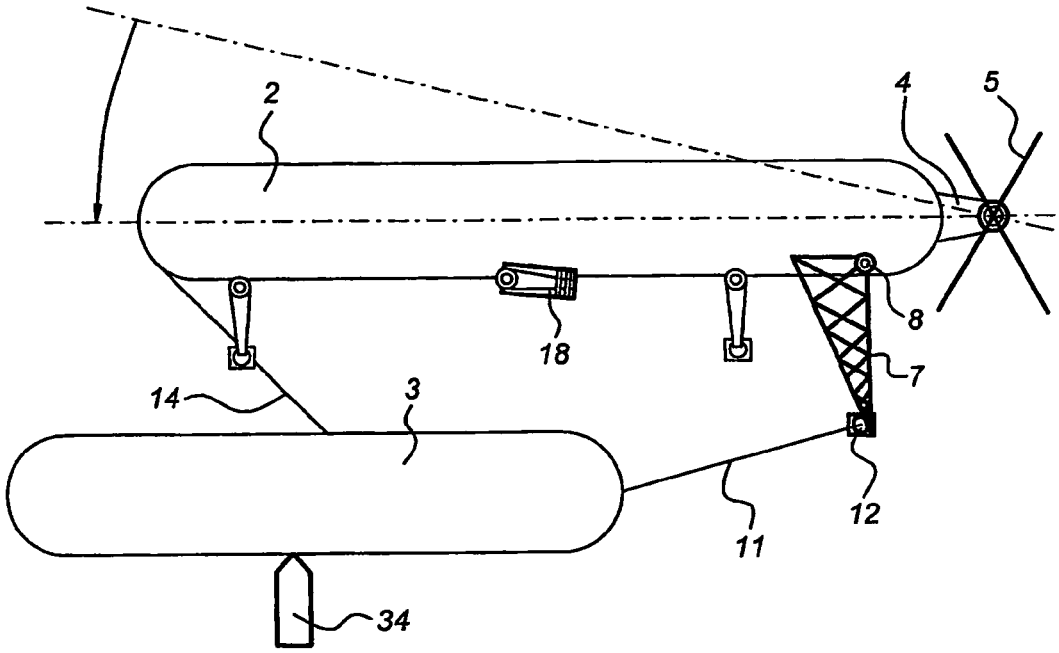

The fenders 15, 16 are extended transversely to the FSRU. The hawser 11, attached to the pulling force element 12 on the end of the arm 7 is attached to the bow of the carrier 3 in FIG. 6*b*, and the mooring line 14 is attached to the stem of the FSRU 3, and the carrier 3 as shown in FIG. 6*c*. The tug 34 pushes the carrier 3 sideways towards the FSRU 2, until it contacts the fenders 15,16 while the hawsers 11, 14 are shortened, for instance by winding them on a winch on board of the FSRU 2, and on the pulling force element 12 respectively.

Figure 6D:
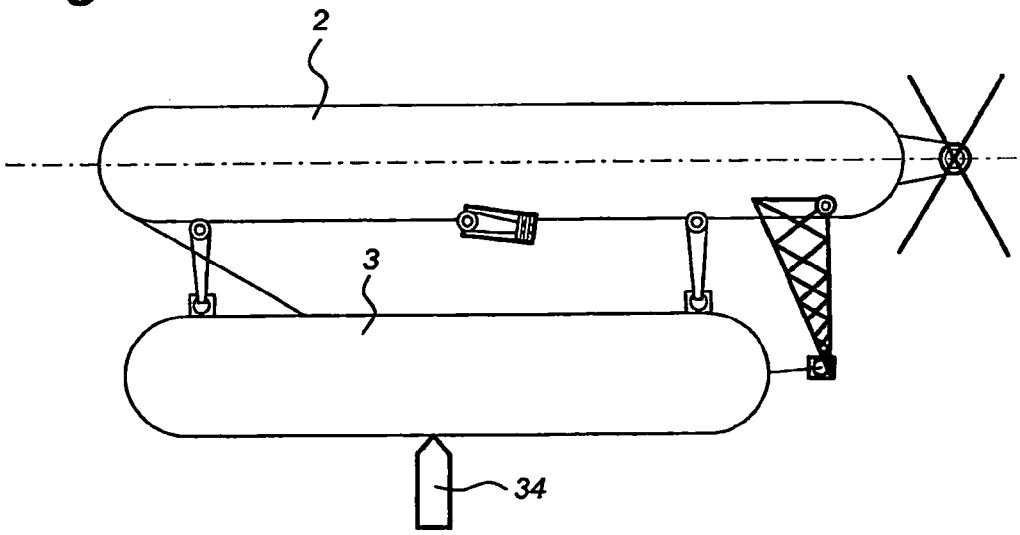
Figure 6E:
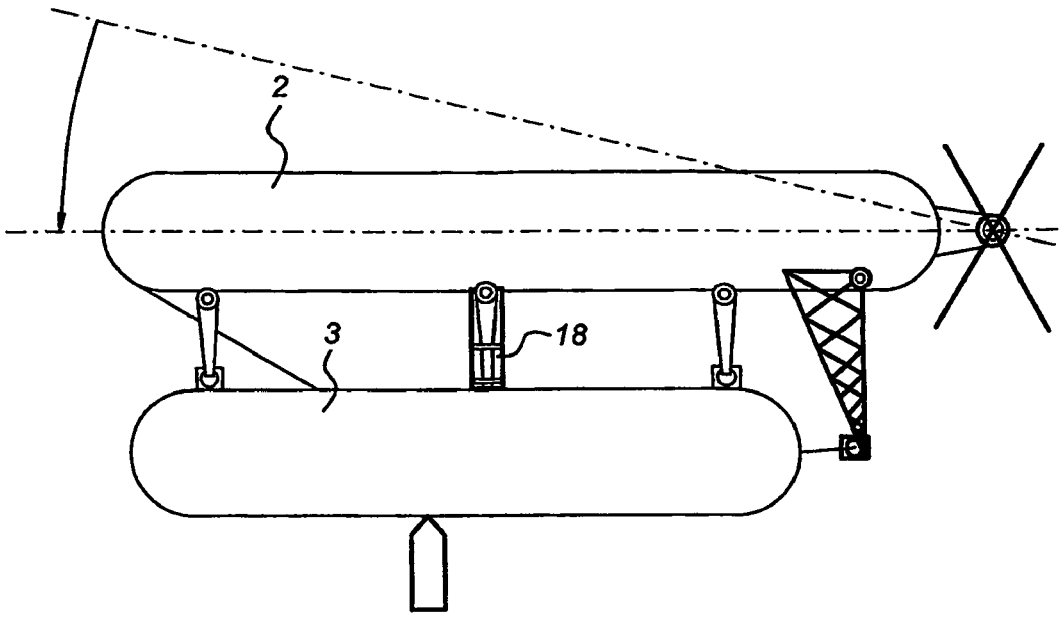

After the carrier has been placed in the proper mooring position as shown in FIG. 6*d*, the fluid transfer means 18 are connected as shown in FIG. 6*e* for transfer of LNG from the tanks 19 on the FSRU to the tanks 20 on the carrier 2.

Figure 7:
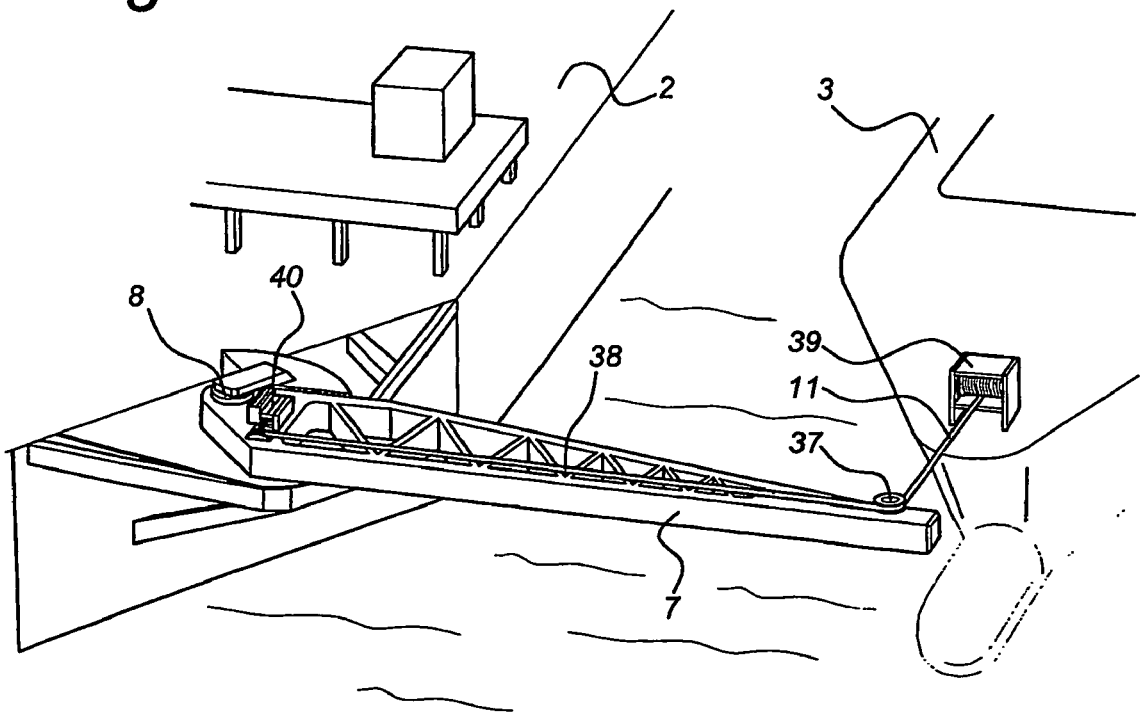
FIGS. 7 and 8 show a detail of the transverse mooring arms at the bow and the stem of the FSRU, respectively.
Figure 8:
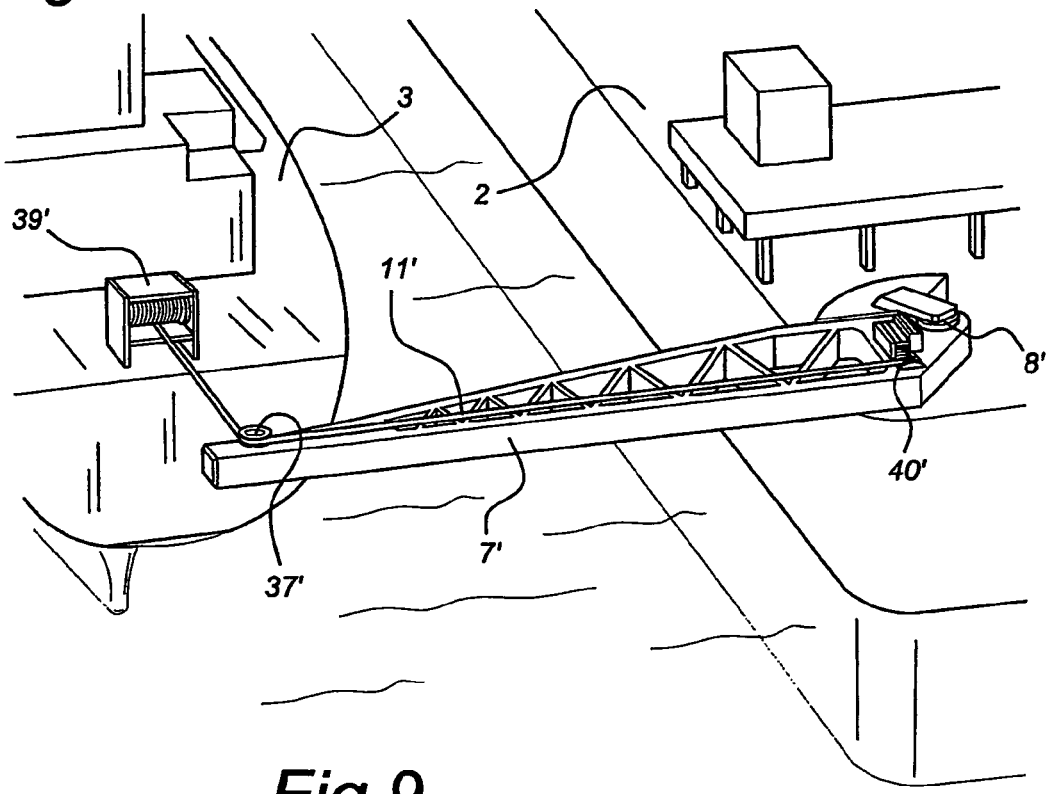

In FIG. 7 the arm 7 is shown in more detail. The hawser 11 extends from a winch 39 on the carrier 3, via a sheave 37 on the end of the arm 7 to a winch 40 on the FSRU 2. FIG. 8 shows a similar construction at the stern of the FSRU 2 and carrier 3.

Figure 9:
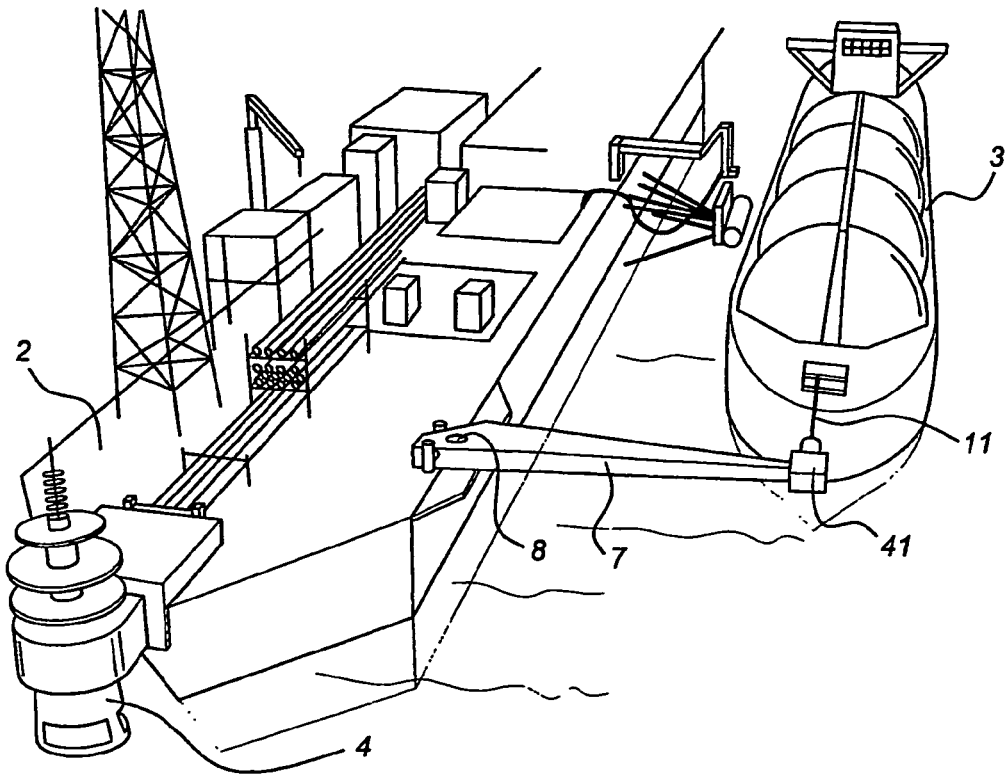
FIGS. 9-11 show different embodiments of the pulling force element acting on the hawser at the end of the transverse mooring arm.
Figure 10:
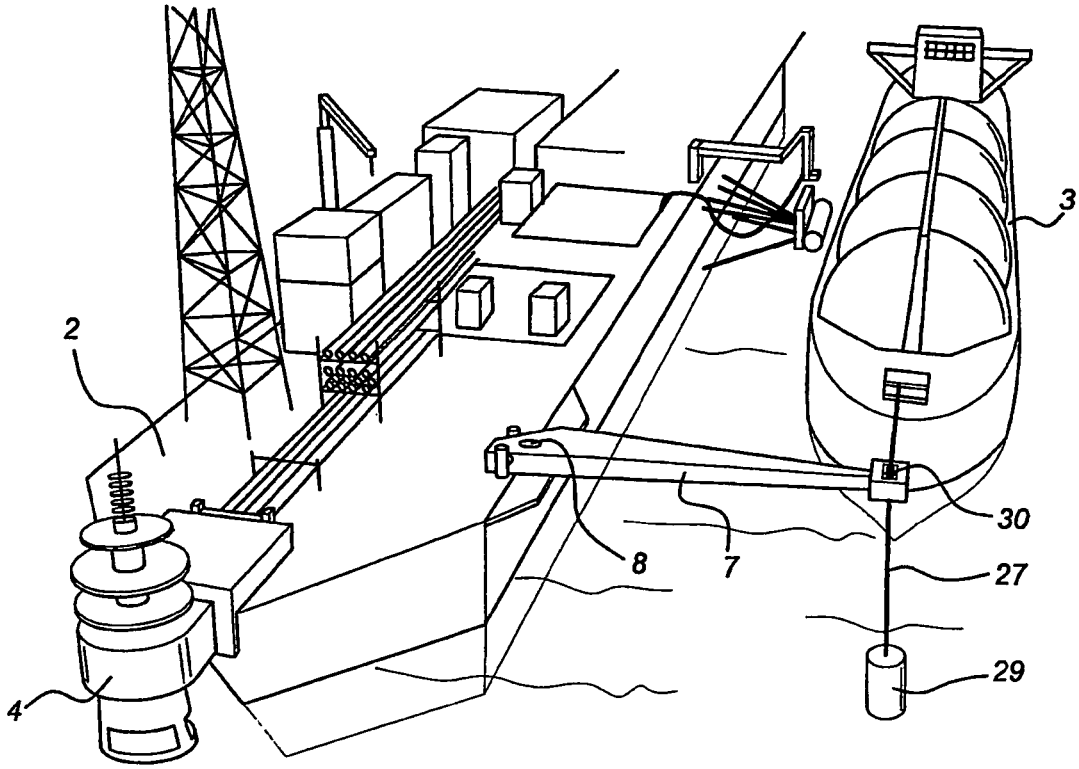
Figure 11:
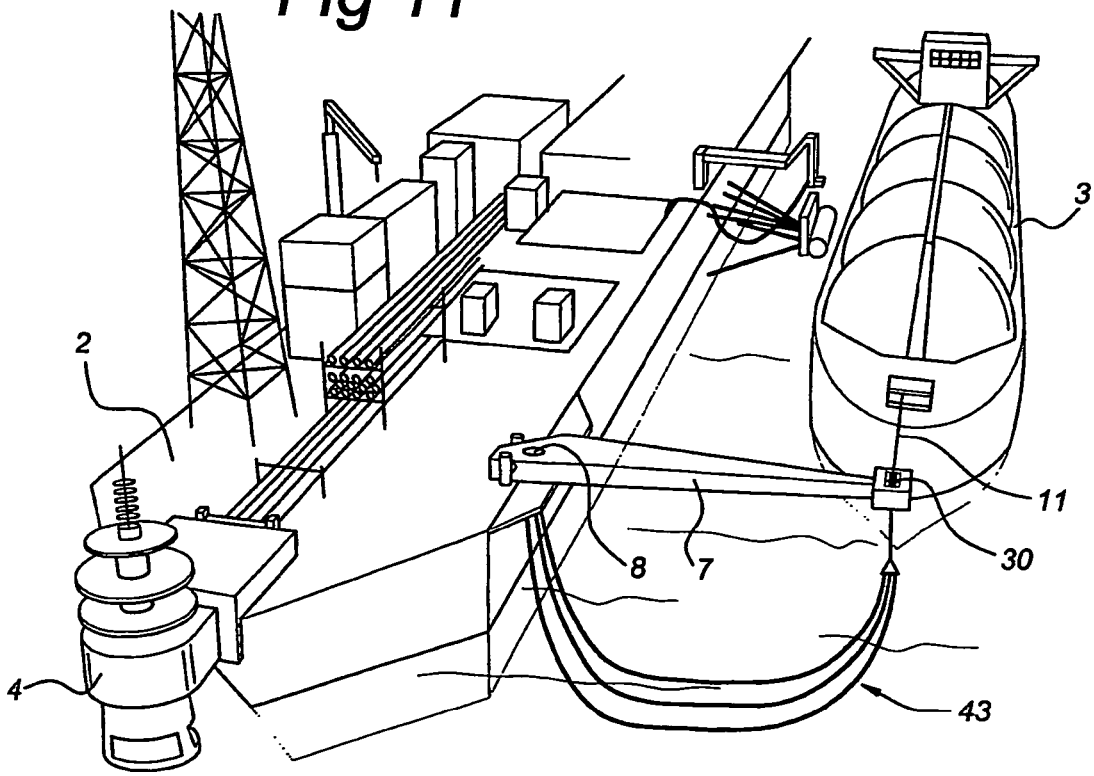

In FIG. 9, a hydraulic cylinder 41 is placed on the end of the arm 7 for exerting a pulling force on the hawser 11. In the embodiment of FIG. 10, a cable 27 and submerged counterweight 29 are attached to the hawser 11 via a sheave 30 on the end of the arm 7. In FIG. 11, a number of submerged chains 43 are connected on one side to the FSRU 2 and on the other side to the end of cable 27 which is attached to the hawser 11 via a sheave 30. The chains 43 act as a breakwater and prevent wave build up between the vessels 2, 3.

Figure 12:
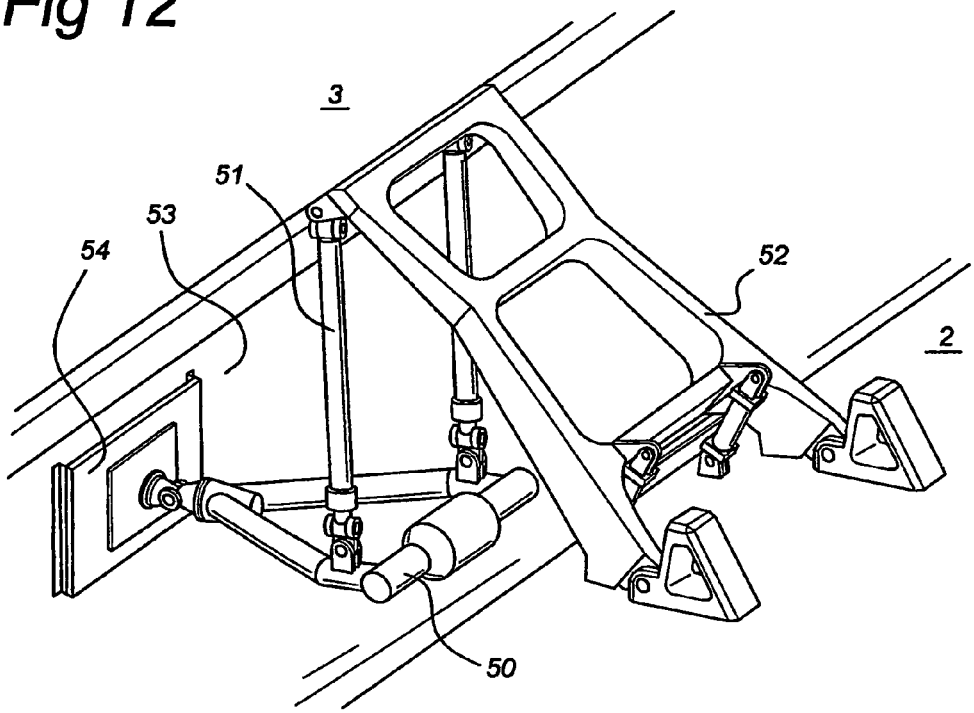
FIGS. 12 and 13 show a soft yoke fender and a hydraulic fender, respectively, for maintaining a predetermined separation between the vessels.
Figure 13:
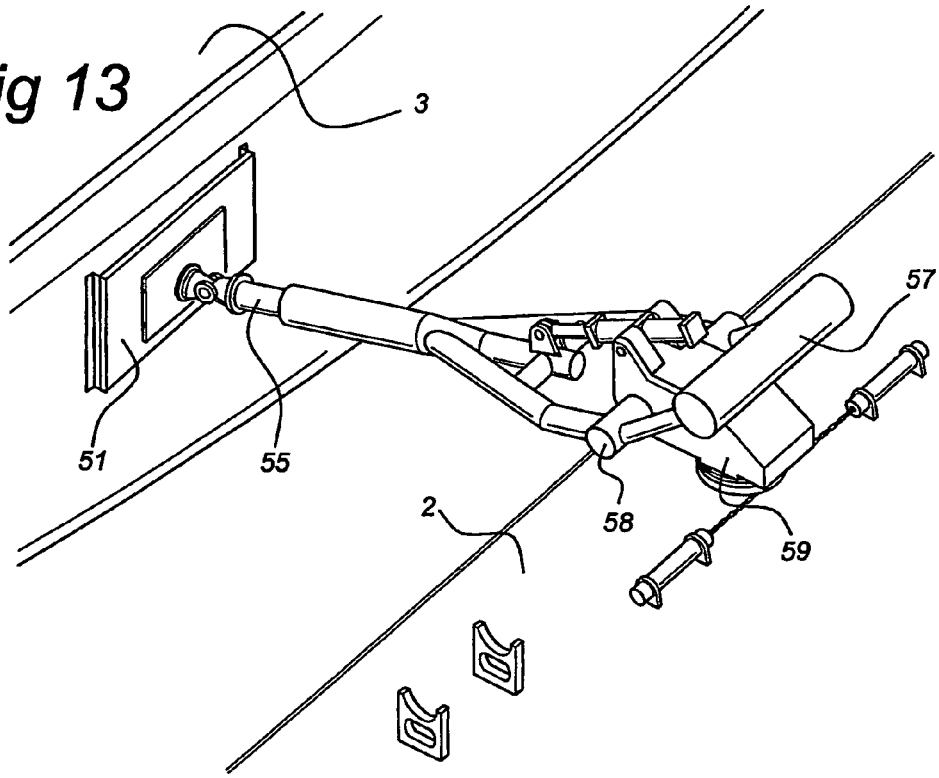

In FIG. 12 a soft yoke fender is shown for maintaining a predetermined distance between the carrier 3 and the FSRU 2. A delta frame 50 is suspended from arms 51 attached to a vertical frame 52 on the FSRU. A magnetic or a vacuum creating plate 54 at the end of the frame 50 attaches to the hull 53 of the carrier 3. In the embodiment of FIG. 13, a hydraulic cylinder 55 is attached to a support frame 59 on the FSRU 2, via a hinge axis 58. The end part of the hydraulic cylinder is attached to a counterweight 57.

Figure 14:
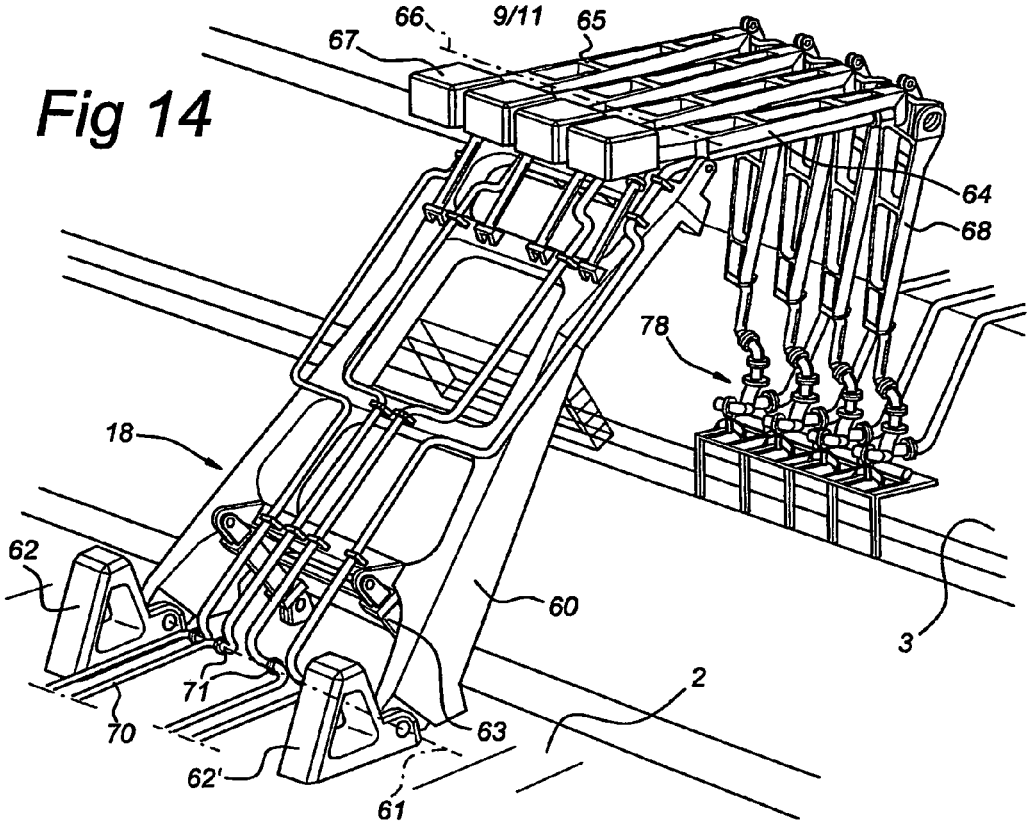
FIGS. 14 and 15 show a perspective view of fluid transfer means according to the present invention.
Figure 15:
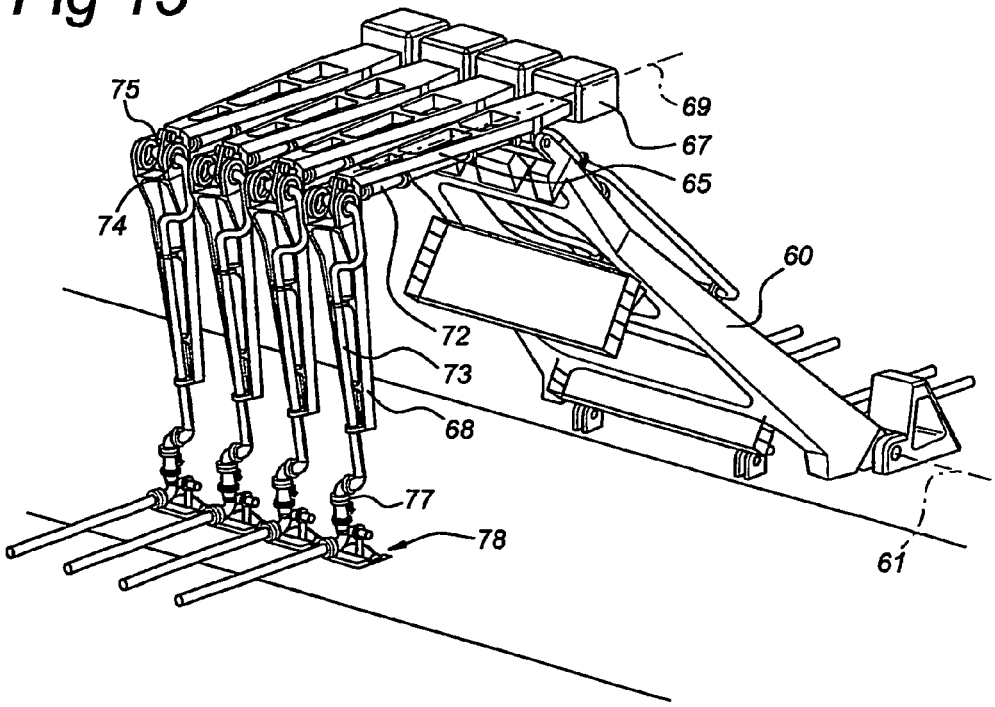

In FIG. 14, the fluid transfer means 18 are shown in detail. A frame 60 is connected to the deck of the FSRU, in supports 62, 62' such as to be hingeable around axis 61. Hydraulic cylinders 63 control the inclination of the frame 60. A number of transverse arms 64, 65 are connected to the top of the frame 60, pivotable around axis 66, extending in the length direction of the vessels 2, 3. The transverse arms 64, 65 carry at one end a counterweight 67 and at their other end a vertical support arm 68. The vertical support arm 68 can rotate around an axis 69 extending in the length direction of the transverse arms 64, 65. Hard piping 70, attached to the tanks 19 on the FSRU extend via swivels 71 along the frame 60. A transverse pipe section 72 extends along the transverse support arms 64, 65, and is attached to a vertical duct 73 via two swivels 74, 75. The coupling end 77 of the vertical duct is attached to a manifold 78 on the tanker 2.

Figure 16:
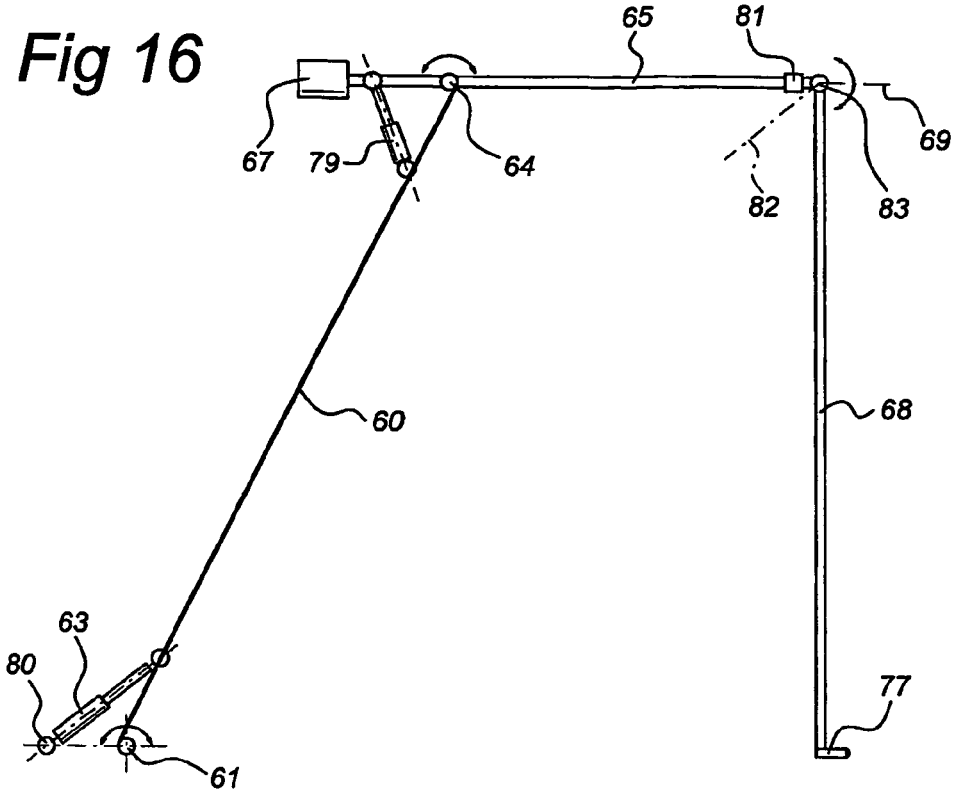
FIGS. 16-18 show a schematic representation of a first embodiment of the fluid transfer means wherein the vertical transfer duct comprises a rigid steel pipe.
Figure 17:
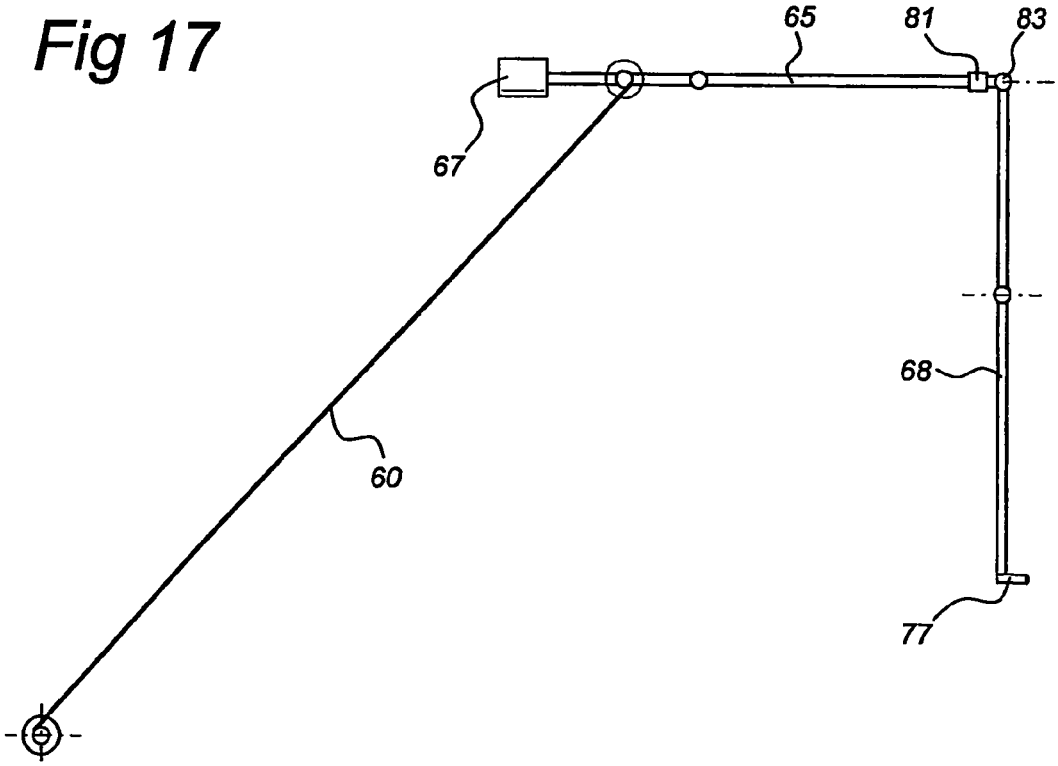

In FIGS. 16 and 17 as schematic view is given of the frame 60, attached to the deck of the FSRU via hinge axis 61 extending perpendicular to the plane of the drawing. The hydraulic cylinder 63 controls the inclination of the frame 60 and is on one end 80 attached to the deck of the FSRU and with its other end connected to the frame 60. The transverse arm 65 is attached to the frame 60 hingingly around hinge axis 64 extending perpendicular to the plane of the drawing. The vertical support arm 68 is suspended from the end of the transverse arm 65 to be hingeable around the axis 69 extending parallel to the arm 65 in a hinge 81 and around axis 82 extending perpendicular to the plane of the drawing in a hinge 83.

Figure 18:
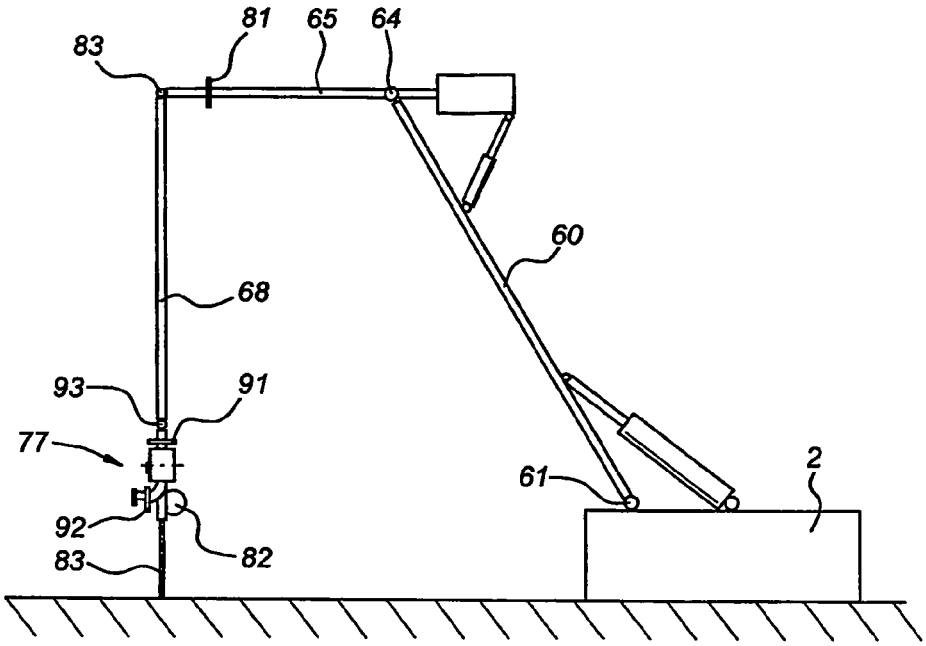

In FIG. 18 the in line swivels 81, 91 and 92 (three in total) and the out of plane swivels 61, 64, 83 and 93 (four in total) of the support frame (and hence of the transfer ducts) are shown in a schematic way. The coupling end 77 of the vertical duct 73 comprises a pull in line winch 82 and a pull in line 83 for attaching to the manifold 78 on the carrier.

Figure 19:
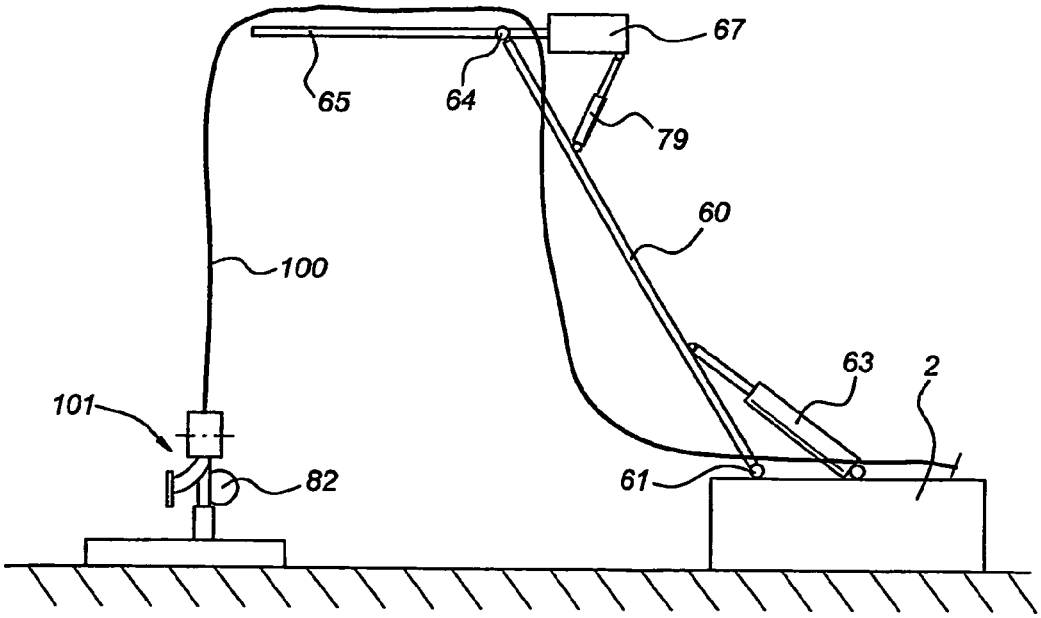
FIG. 19 shows a schematic representation of a second embodiment of the fluid transfer means according to the present invention, wherein the vertical transfer duct comprises a flexible hose.

In the embodiment of FIG. 19, a flexible hose 100 is suspended from the transverse arm 65, the hose comprising at its end part coupling means 101 for attaching to the manifold on the carrier 2.

Instead of a FSRU, the vessel can comprise a power plant with hydrocarbon storage tanks and power generators or a gas liquefaction and liquefied gas storage plant.

The invention claimed is:

1. A mooring system comprising:

a floating structure for containing hydrocarbons; and a fluid transfer means on a deck of the floating structure with a coupling end for connecting to a vessel having a length direction, the vessel moored alongside of the floating structure via a mooring device allowing relative movement of the vessel with respect to the floating structure in the length direction of the vessel, wherein the fluid transfer means comprise a frame extending upwardly from the deck at a side of the floating structure, at least two transverse arms being hingingly connected to an upper end of the frame around an axis that extends in the length direction of the vessel, a counterweight being placed on a first end of each of the at least two transverse arms and a respective vertical fluid duct being supported from a second end of each of the at least two transverse arms, the vertical ducts each having at an end a connecting member for attaching to the vessel, the vertical ducts being displaceable in the length direction of the vessel, and wherein the frame and the transverse arms are not rotatable around a vertical axis.

2. The mooring system according to claim 1, wherein the frame is hingingly attached to the structure around an axis and extends in the length direction of the vessel, an inclination force element is connected between the frame and the vessel for controlling the inclination of the frame, and a pivoting force element is connected to the frame and at least one of the at least two transverse arms, for pivoting of the at least one transverse arm relative to the frame.

3. The mooring system according to claim 1, wherein the floating structure comprises a transverse mooring arm which during use, is fixed in position, and a pulling force element is attached to a cable extending to the bow of the vessel, substantially in the length direction of the vessel, for applying a pulling force on the vessel upon relative movement of the vessel with respect to the mooring arm.

4. The mooring system according to claim 3, wherein the pulling force element comprises a hydraulic cylinder.

5. The mooring system according to claim 3, wherein the pulling force element comprises a constant tension winch.

6. The mooring system according to claim 3, wherein the pulling force element comprises a counterweight, attached to the cable which runs from a sheave near the mooring end of the arm to the bow of the vessel.

7. The mooring system according to claim 6, wherein the counterweight is situated below water level.

8. The mooring system according to claim 3, wherein the mooring arm is attached to the vessel in a hinge point and can be pivoted to a parking position in which the mooring arm is situated substantially in the length direction of the vessel.

9. The mooring system according to claim 3, wherein the mooring arm is pivotably connected to a mooring point that is anchored to the seabed.

10. The mooring system according to claim 1, wherein the vertical ducts each include a rigid pipe connected to the transverse arm via a swivel having a rotational axis extending in a length direction of the transverse arms.

11. The mooring system according to claim 1, wherein the vertical ducts each include a flexible hose.

* * * * *